US006896294B2

(12) United States Patent
Bidanset et al.

(10) Patent No.: US 6,896,294 B2
(45) **Date of Patent: *May 24, 2005**

(54) PAGE MARKING DEVICE

(75) Inventors: Edward Bidanset, Mullica Hill, NJ (US); Aaron Hollander, Stamford, CT (US)

(73) Assignee: Imtek, Inc., Bridgeport, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/336,875

(22) Filed: Jan. 6, 2003

(65) Prior Publication Data

US 2003/0178840 A1 Sep. 25, 2003

Related U.S. Application Data

(63) Continuation of application No. 08/796,374, filed on Feb. 6, 1997, now Pat. No. 6,526,906, which is a continuation-in-part of application No. 08/733,819, filed on Oct. 18, 1996, now abandoned.

(51) Int. Cl.[7] ..... B42F 21/00

(52) U.S. Cl. ..... 283/38; 281/15.1; 281/22; 283/36; 283/63.1

(58) Field of Search ..... 283/36, 37, 38, 283/39, 40, 41, 42, 61, 62, 63.1; 281/2, 3.1, 5, 15.1, 22, 36, 37, 38, 51

(56) References Cited

U.S. PATENT DOCUMENTS

| | | | | | |
|---|---|---|---|---|---|
| 3,517,947 | A | * | 6/1970 | Bennett | 283/56 |
| 3,583,358 | A | * | 6/1971 | Hanson, Jr. | 116/235 |
| 3,958,816 | A | * | 5/1976 | Remmey, III | 283/38 |
| 4,978,143 | A | * | 12/1990 | Ericson | 283/38 |
| 5,056,824 | A | * | 10/1991 | Olson | 283/36 |
| 5,249,827 | A | * | 10/1993 | Olson | 283/36 |
| 5,462,783 | A | * | 10/1995 | Esselmann | 428/42.1 |
| 5,582,295 | A | * | 12/1996 | Bryndle | 206/447 |
| 5,641,182 | A | * | 6/1997 | Schwandt | 283/36 |
| 6,145,883 | A | * | 11/2000 | Jeter | 283/37 |
| RE37,371 | E | * | 9/2001 | Gerow | 273/139 |
| 6,308,991 | B1 | * | 10/2001 | Royer | 283/102 |
| 6,526,906 | B1 | * | 3/2003 | Hollander et al. | 116/234 |

* cited by examiner

*Primary Examiner*—Monica S. Carter
(74) *Attorney, Agent, or Firm*—Kirkpatrick & Lockhart Nicholson Graham LLP; Anthony H. Handal

(57) ABSTRACT

An page marking device is disclosed. The marking device is part of a book. The book has a tab assembly carrier. The carrier has a plurality of removable tabs disposed on the carrier. Printed indicia is located on the tabs. The tabs are secured to the carrier by a non-aggressive adhesive allowing the tabs to be removed from the carrier relocated and/or removed again as required by the user of the device. Printed indicia may also be located on or beneath said carrier.

21 Claims, 9 Drawing Sheets

PAGE MARKING DEVICE

CROSS-REFERENCE TO RELATED APPLICATIONS

This is a continuation of U.S. patent application Ser. No. 08/796,374 filed Feb. 6, 1997 now U.S. Pat. No. 6,526,906, which, in turn, is a continuation-in-part of U.S. patent application Ser. No. 08/733,819, filed Oct. 18, 1996 now abandoned. The entire disclosures of the aforementioned U.S. patent applications are hereby incorporated herein by reference thereto.

TECHNICAL FIELD

The present invention relates to place marking devices for catalogs or the like and a book such as a catalog incorporating the same.

BACKGROUND

The use of a mechanical member for marking a place in an item of written material, such as a book, is probably as old as writing itself. Such devices include bookmarks, index tabs, and in more traditional items of printed matter, such as bibles, ribbons bound into the spine of the book.

Perhaps the most common example of such a device is a common bookmark, which generally consists of a strip of light cardboard, typically about three centimeters in width and ten centimeters long. It is common for such bookmarks to have a wide range of different types of printed matter on them.

Such printed matter may simply comprise decorative designs or an inspirational saying. Such bookmarks are used by simply being placed between the pages of the book, typically near the spine of the book, to mark a particular page in the book to which a reader wishes to return, or which contains some item of information to which the reader expects to want to refer back.

Bookmarks probably came into use as quickly as some book reader with a scrap of paper, discovered, undoubtedly ages ago, that he could mark his place with it. It would appear that the use of a ribbon secured to the binding at the spine of a book was also a very early innovation, which prevented the ribbon bookmark from being dissociated from the book and lost.

More recently, relatively stiff materials have been used for bookmarks, such as plastic. Accordingly, some bookmarks have a tongue cut into them, allowing the tongue to be placed on one side of a page and the rest of the bookmark on the other side of the same page, in much the manner of a paper clip, allowing the bookmark to remain secured to the page even when the book is opened and the page moved. This also allows placement of the bookmark in a secure fashion at a wide variety of positions remote from the spine or binding of the book.

As can be seen from the above, the structure of bookmarks has remained substantially unchanged for many years. Not surprisingly, when innovation did come, it was slow to be appreciated.

In particular, a few years ago, scientists doing research on adhesive came across an adhesive which, while it was quite stable, was not very aggressive, and thus did not stay in place permanently. It was a failed experiment, and the material was not much unlike other rejected adhesives. Nevertheless, one of the people who was working with that adhesive was involved with a church choir and began to consider the possibility of using the adhesive to hold bookmarks in place to mark hymns which were scheduled to be sung at the church services.

This was tried, successfully, and the idea evolved into a movable adhesive note. These were manufactured and the research team believed it to be a meritorious product for inclusion in the company's line. Nevertheless, their employer, 3M Corporation had decided against putting an effort behind this product. Accordingly, the research and development people involved with the product distributed their samples of the product to the clerical staff in management. After the management staff became accustomed to using the product, the supply was cut off and the clamoring of the former users of the new product eventually lead management to institute an aggressive and remarkably successful marketing program for this new product. Included in the product line at this time is a plastic marking device intended for use as indexes and flags.

In similar fashion, pages carrying adhesive members have also been bound into books and intended for use as flags. Such flags are adhered to the outside edge of a page in a book and are color coded in a number of colors and include blank spaces for the entry of information which the flag is intended to help the user relocate easily. In accordance with such systems, the page carrying the adhesive members may also be removed.

The above systems suffer from a number of inadequacies, however, which the inventive system does address. First, the flags contain no application specific information and thus require users to develop a system to use the flags. In some cases, this may be preferred, but especially in certain consumer related contexts, organization and ready provision of a working system are essential to success. This is believed to be particularly the case with systems meant to facilitate and encourage purchasing of goods by the consumer.

Still yet another failing of some of the prior art is the likelihood that a page of adhesive members will not be used because it is bound into the book. In the case of a catalog, this would decrease the ability of the catalog to function as a product locating tool, as once a product is located, if its position is not securely marked, and the catalog is closed, the position would be lost.

Even in the case where the page of adhesive markers is removable from the catalog, once removed, it can easily be lost, and thus compromise the effectiveness of the system.

SUMMARY OF THE INVENTION

The invention, as claimed, is intended to provide a remedy. It solves the problem of how to mark pages in a book such as a catalog easily and effectively.

A page marking device is disclosed. The page marking device comprises a book. The book has a tab assembly carrier. The carrier has a plurality of removable tabs disposed of on the carrier. The tabs are secured to the carrier by a non-aggressive adhesive allowing the tabs to be removed from the carrier relocated and/or removed again as required by the user of the device. The carrier can be placed in the same location as the peel away address label enclosed with the catalog.

BRIEF DESCRIPTION OF THE DRAWINGS

One way of carrying out the invention is described in detail below with reference to drawings which illustrate only one specific embodiment of the invention and in which.

DETAILED DESCRIPTION OF THE PREFERRED EMBODIMENTS

Figure 1:
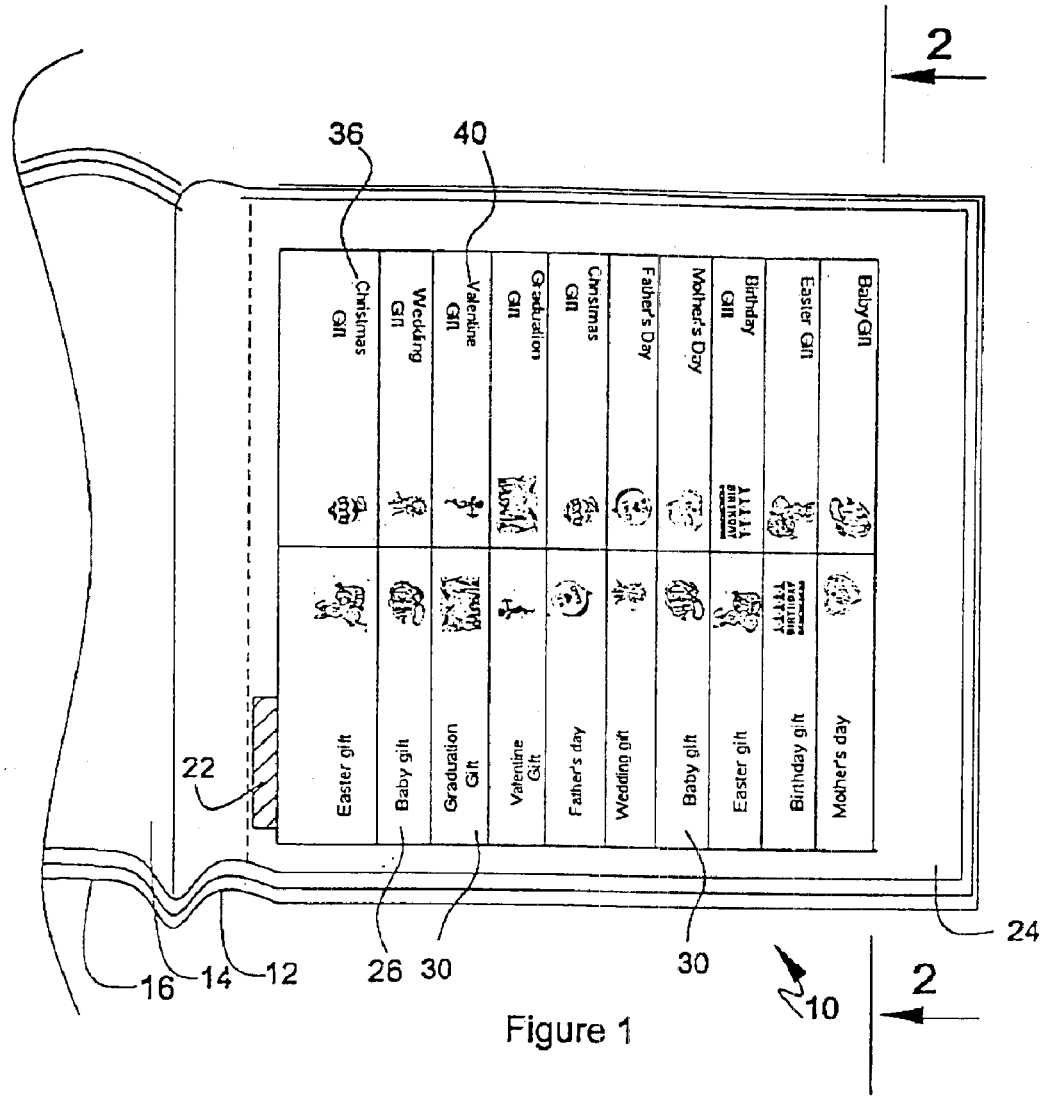
FIG. 1 is a view of a catalog constructed in accordance with the present invention.

Turning to FIG. 1, a book 10 constructed according to the present invention is illustrated. Book 10 generally comprises a number of pages 12, 14 and 16. As illustrated more clearly in FIG. 2, page 12, which, for example, may be the front or back cover of book 10 has disposed thereon a tab assembly 18.

Tab assembly 18 is secured to page 12 by a non-aggressive or so-called temporary adhesive 20 such as that used in Post-it brand note pads made by 3M Corporation, which allow the tab assembly 18 to be removed from and replaced on page 12, or another page that the user finds convenient. Such suggestion respecting the placement of tab assembly 18 may be printed directly on tab assembly 18 at, for example, position 22 as illustrated in FIG. 1.

Alternatively, depending upon the intended use of book 10, or dependent upon what market research might indicate as being preferable, the tab assembly 18 may be made permanently secured to page 12. However, in accordance with the embodiment illustrated in FIGS. 1 and 2, it is contemplated that a temporary adhesive 20 will be used to allow the tab assembly 18 to be removed, put beside open book 10, which may be a catalog, for example, and referred to by the user as he is reading the catalog.

Again referring to FIG. 2, it is noted that the tab assembly comprises a carrier sheet 24 which may be made of paper or other suitable material such as plastic, composite fiber, composite fiber plastic, or the like. Adhered to carrier 24 is a plurality of tabs 26 which include a patch of temporary non-aggressive adhesive 28 and printed indicia.

Figure 2:
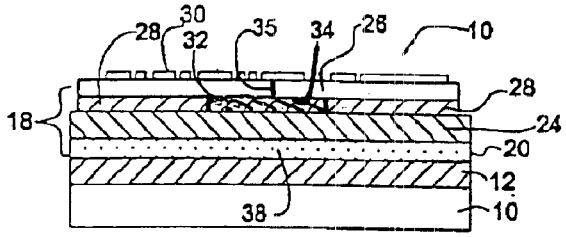
FIG. 2 is a cross-sectional view along lines 2—2 of FIG. 1.

As can be seen in FIG. 2, only a portion of the undersurface 32 of tabs 26 are covered with adhesive 28. Accordingly, a portion of the undersurface 34 is left free of adhesive, allowing the tab 26 to be easily removed and also providing for a portion of the tab which will not adhere to dust or surfaces of objects when the tab is in use, extending from the edge of a closed book.

Referring back now to FIG. 1, tabs 26 may be positioned into a pair of columns 21 and 23 on carrier 24. Each column comprises a plurality of tabs 26.

Tabs 26 may be positioned so that undersurface 34 of tabs 26 aligns with undersurface 34 of tabs 26 in columns 21 and 23. Accordingly, the center line 35 of tab assembly 18 will comprise the portion of tabs 26 which is left free of adhesive. This feature will allow for convenient removal of any one of tabs 26 located on either side of center 35, by simple bending parallel to the center line 35, to cause the edge of the tabs 26 to extend from the rest of the assembly 18 for easy gripping.

Likewise, in accordance with the preferred embodiment of the invention, a portion 36 of the underside 38 of carrier 24 is free of temporary adhesive, as illustrated in FIG. 1. This allows the carrier and the rest of the tab assembly to be removed and used when the book is open to any page, as discussed above. After such use the tab assembly may be put back into book 10 by being adhered to any page.

In accordance with the preferred embodiment of the invention, the printed indicia 30 falls into two categories. One is a verbal description 40 of the intended flagging use of the particular tab and the other is a shortened version 40 of the same information typically in pictographic form, as illustrated in FIG. 1.

In accordance with the preferred embodiment of the invention, if the book 10 is a catalog, and it includes a tab assembly such as tab assembly 18 bearing, for example, a set of messages related to the substance of the book, in this case a catalog, it is intended that the user will remove individual tabs from the tab assembly and use them as markers.

Figure 3:
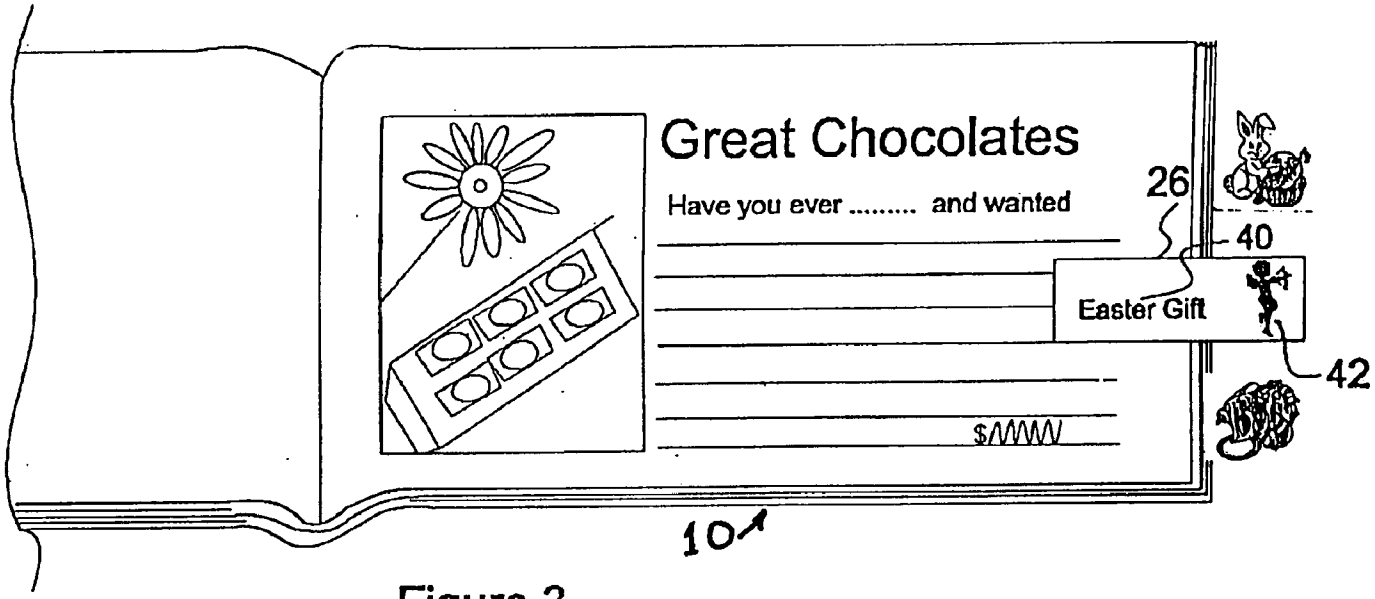
FIG. 3 is a view of a page of the inventive catalog in use.

To consider in detail the disclosed embodiment, consider a catalog book 10 which includes numerous products, such as candy, baby's rattles, pens, flowers, ties, and so forth. As the user goes through the book, with, for example, the tab assembly removed and in his view as he is looking at the pages, he would take the "Easter Gift" tab 26 it adheres it to the edge of a page of the book with the pictograph 42 sticking outside the confines of the page edges, as illustrated in FIG. 3.

Thus, if the book is closed, the tab will still stick out and the position of the "Easter Gift" tab will not be lost. At the same time, the illustration beside the words "Easter Gift" will be visible from the outside and will indicate the substance of the subject matter being marked. Likewise, the same user as he goes through, the book will have the option of putting the "Baby Gift" tab 26 beside the baby rattle on the page where the baby rattle is displayed, the "Graduation Gift" tab 26 on the page where the pen is and, for example, the "Valentine Gift" tab 26 near the flowers offered for sale in the book.

Figure 4:
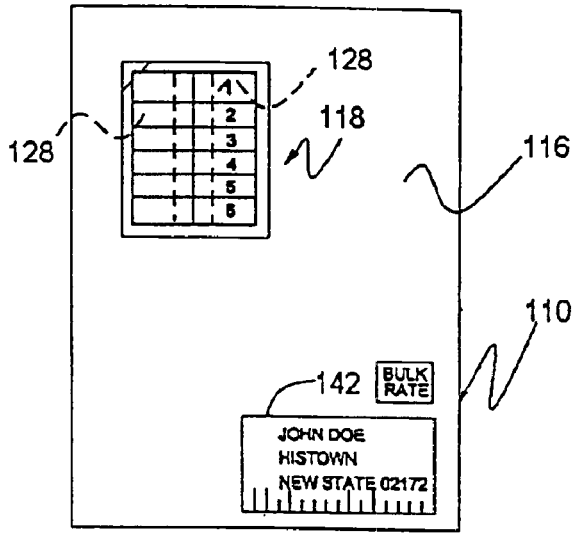
FIG. 4 is a view of an alternative embodiment of the invention.

An alternative embodiment is illustrated in FIG. 4. Generally, similar parts or parts performing analogous, corresponding or identical functions to those of the FIG. 1 embodiment are numbered herein with numbers which differ from those of the earlier embodiment by multiples of one hundred.

Turning to FIG. 4, an alternative embodiment of the present invention may be understood. In accordance with this embodiment of the invention, a catalog 110 is provided with a tab assembly 118 on the back cover 116 of catalog 110. The tab assembly 118 is on the same side of the same piece of paper as an address label 142, which may also be designed to be removed and, for example, adhere to an order form, thus insuring that the ordered goods will go to the person who has ordered the same.

Figure 5:
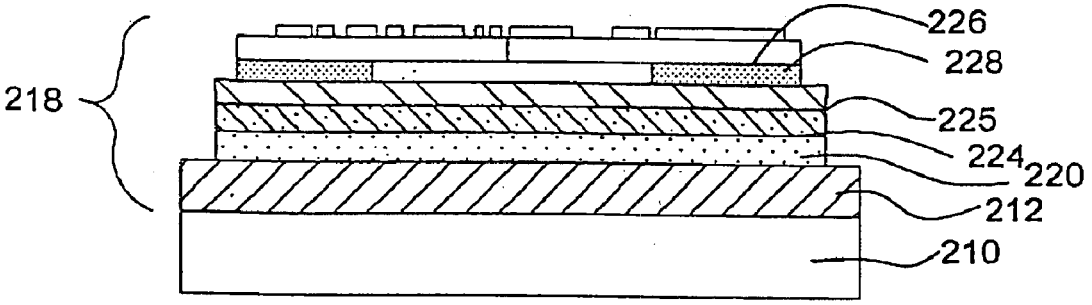
FIG. 5 is a view of another embodiment of the invention.

Still, yet another embodiment of the invention is illustrated in FIG. 5. Here a page of a book 210 constructed according to the present invention is illustrated. As illustrated more clearly in FIG. 5, page 212, which, for example, may be the front or back cover of book 210 has disposed thereon a tab assembly 218. Tab assembly 218 is secured to page 212 by a non-aggressive or so-called temporary adhesive 220 which allow the tab assembly to be removed from and replaced on page 212, or another page that the user finds convenient. Alternatively, depending upon the intended use of book 210, or dependant upon what a market research might indicate as being preferable, the tab assembly 218 may be made permanently secured to page 212. However, in accordance with the embodiment illustrated in FIG. 5, it is contemplated that a temporary adhesive 220 will be used to allow the tab assembly 218 to be removed, and put beside book 210.

Again referring to FIG. 5, it is noted that the tab assembly comprises a carrier sheet 224 which may be made of paper or other suitable material such as plastic, composite fiber, composite fiber plastic, or the like. Carrier sheet 224 is covered with a release agent layer 225 which may be plastic coating, wax coating or any suitable material which will allow an adhesive material of relatively permanent nature to be adhered and removed therefrom, in accordance with well-known technology. Adhered to carrier 224 is a plurality of tabs 226 which include a patch of permanent aggressive adhesive 228.

Figure 6:
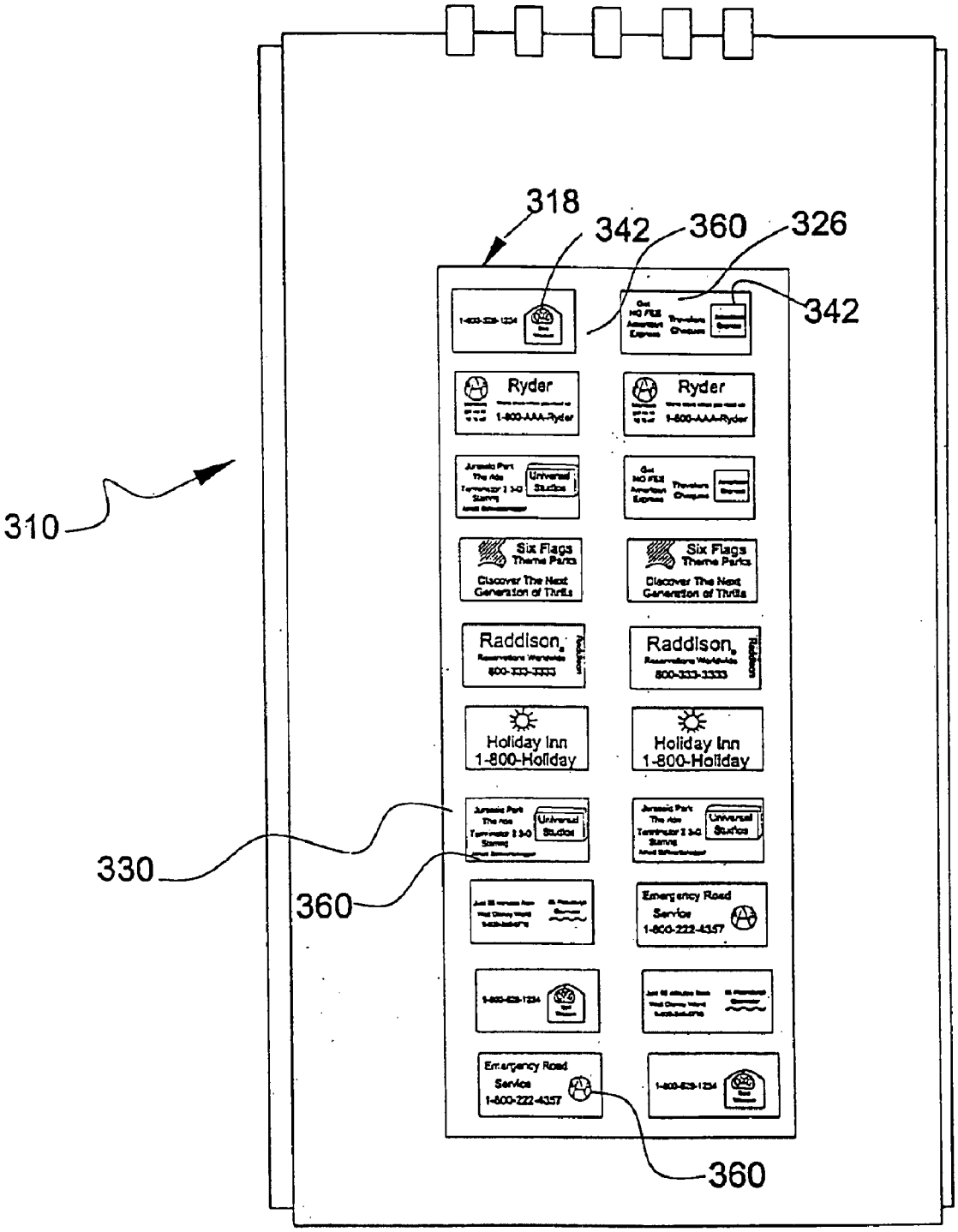
FIG. 6 is a view of still another embodiment of the invention.

Turning to FIG. 6 yet another embodiment of the invention is illustrated. In particular, in the embodiment illustrated in FIG. 6, the invention takes the form of a guide book or other similar traveler's aid which includes a tab assembly 318 including twenty tabs 326 each of which is individually die cut to be removable in the manner of the embodiment illustrated in, for example, FIG. 1. Die cutting is done along lines 360, again as in the FIG. 1 embodiment. In this case, however, the tabs include indicia 330 which consist of advertising matter which include, for example, the names of hotels, or other facilities that may be of interest to travelers.

Figure 7:
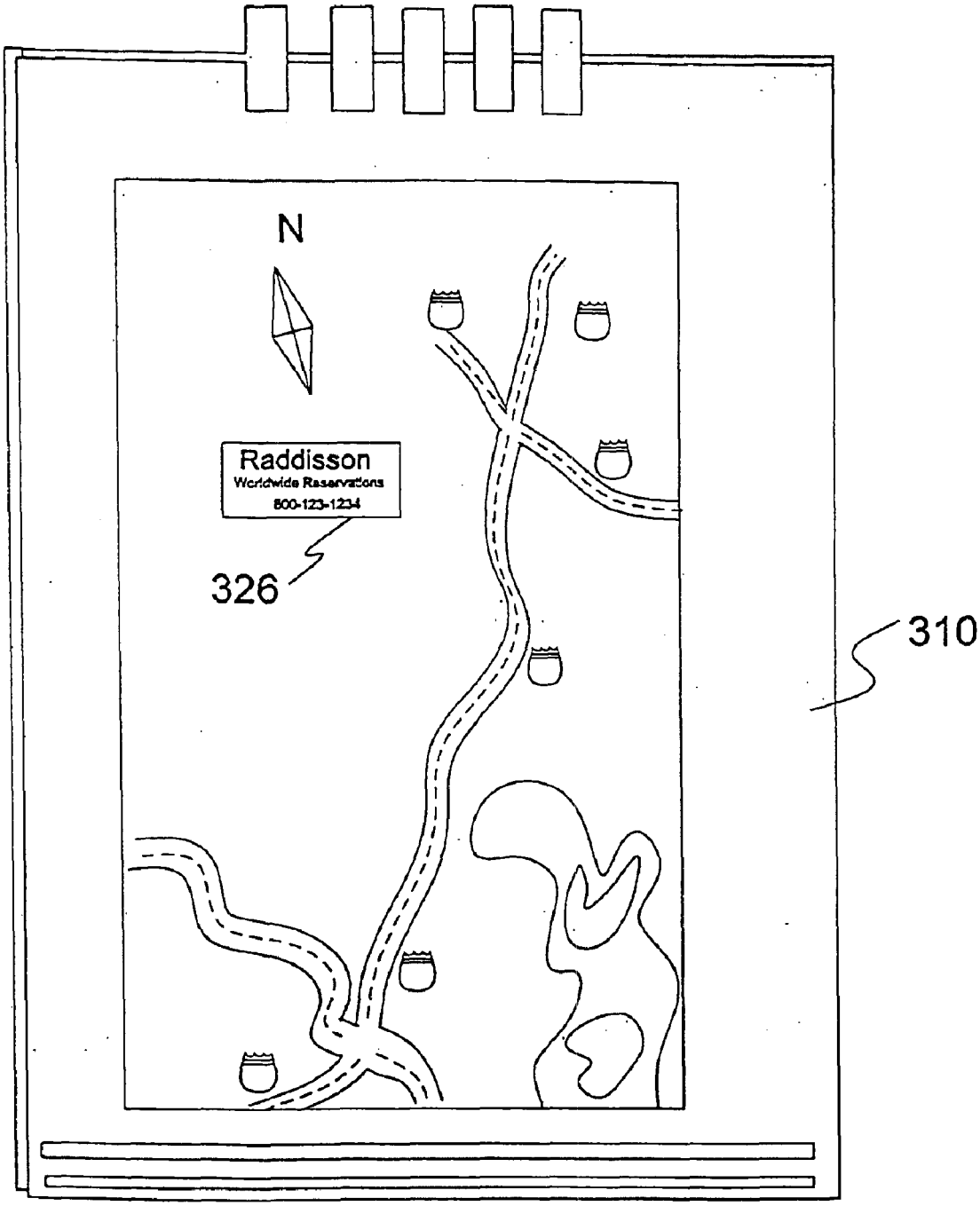
FIG. 7 is a view of still another embodiment of the invention.

The book 310 might also include maps, as illustrated in FIG. 7. Any map might then be marked with a tab 326 for a hotel, as illustrated in FIG. 7.

Figure 8:
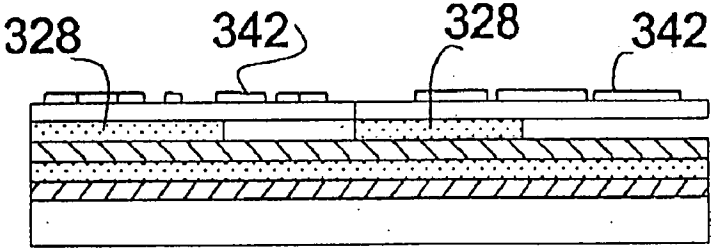
FIG. 8 illustrates yet still another embodiment of the invention.

As is illustrated in FIGS. 6 and 7, the binding of a book 310 constructed in accordance with the invention can take a wide variety of forms, including a plastic spine binder 362 as is illustrated in FIG. 7, as well as more conventional staple binding or the like as illustrated in FIG. 1. It is also noted that because the portions 342 of tabs 326 (intended to stick out of book 310 when it is closed) are all located on the same side of the page, the temporary adhesive 328 underlying tab 326 has a different pattern which is most easily seen in FIG. 8.

Figure 9:
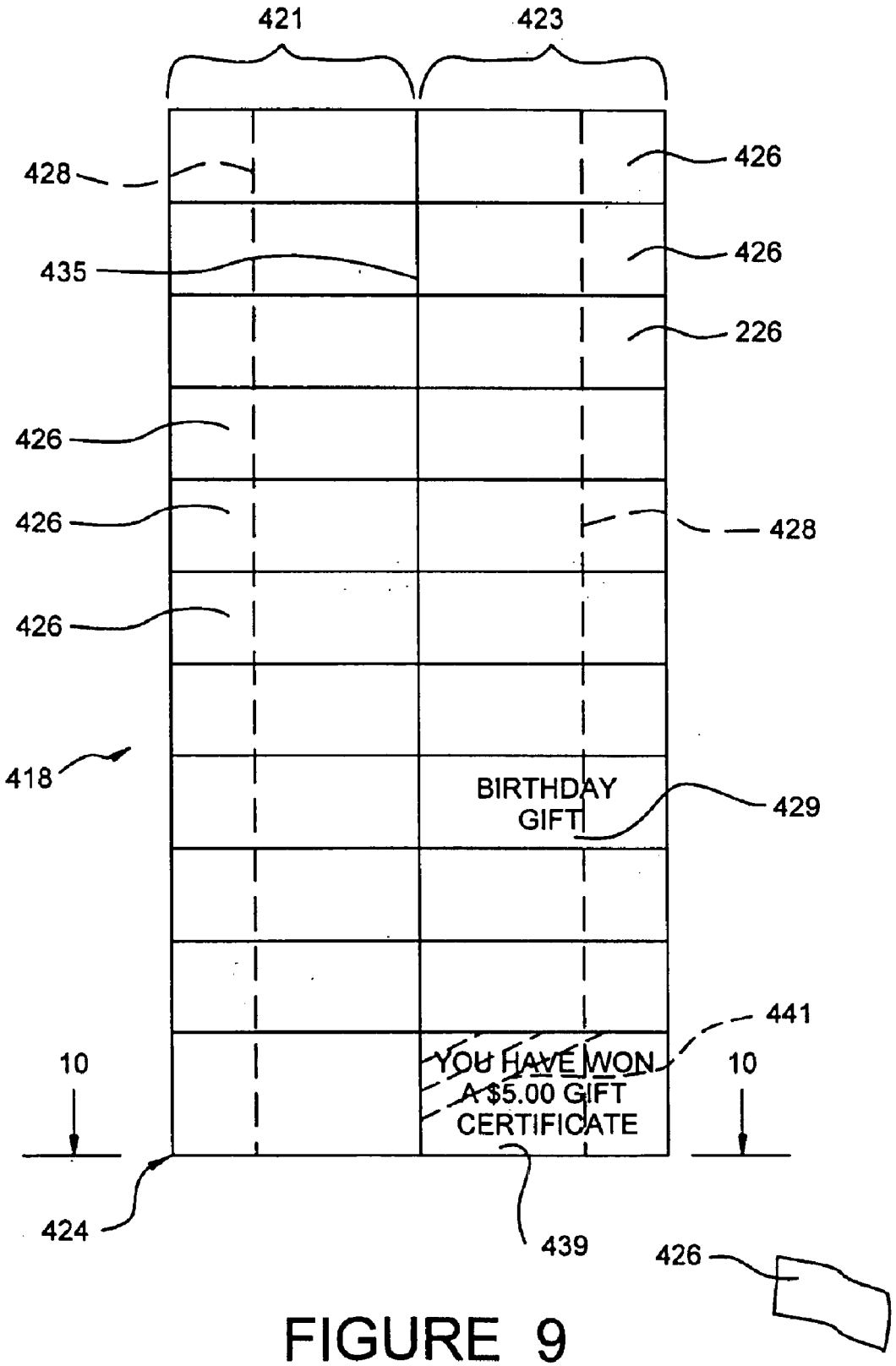
FIG. 9 is a view of still another embodiment of the invention.
Figure 10:
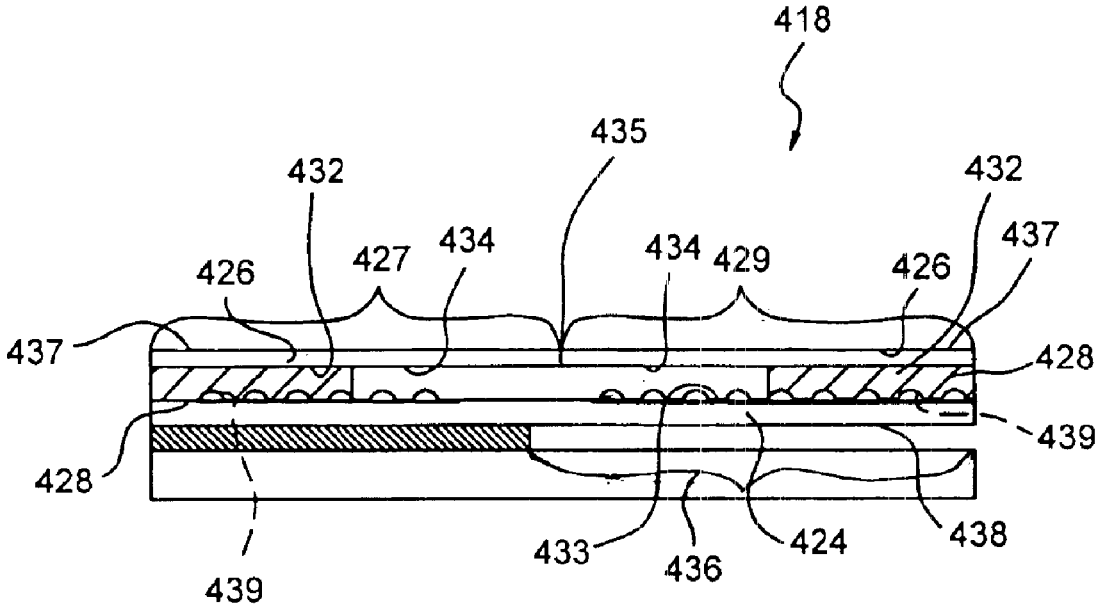
FIG. 10 is a view along lines 10—10 of FIG. 9.

Turning to FIGS. 9 and 10 yet another embodiment of the invention is illustrated. In particular, the tab assembly 418 comprises a carrier sheet 424 which may be made of paper or other suitable material such as plastic, composite fiber, composite fiber plastic, or the like. Adhered to carrier sheet 424 is a plurality of tabs 426, which each include a patch of temporary non-aggressive adhesive 428 on the undersurface 432 of tabs 426 and printed indicia 429 on the upper surface 437 of tabs 426.

As can be seen in FIG. 10, only a portion of the undersurface 432 of tabs 426 is covered with adhesive 428. See also FIG. 9.

In this configuration, a portion 434 of the undersurface 432 is left free of adhesive, allowing tabs 426 to be easily removed and also providing for a portion of the tab which will not adhere to dust or surfaces of objects when the tab is in use, extending from the edge of a closed book.

Referring back now to FIG. 9, tabs 426 may be positioned into a pair of columns 421 and 423 on carrier 424. Each column comprises a plurality of tabs 426. Alternatively, tabs 426 may be positioned into several columns. In accordance with the invention, several carriers 424 may also be positioned throughout the catalog.

Tabs 426 may be positioned so that portion 434 of tabs 426 in column 421 aligns with portion 434 of tabs 426 in column 423. Accordingly, the center 435 of carrier 424 will be defined by portions 434 of tabs 426 which are free of adhesive.

This feature allows for convenient removal of any one of tabs 426 which may be located on either side of center 435. A user may simply bend the catalog 410 or carrier 424 at center 435 until portion 434 of tab 426 may be grasped between the fingers of a user.

Likewise, in accordance with the preferred embodiment of the invention, a portion 436 of the underside 438 of carrier 424 is free of temporary adhesive, as illustrated in FIG. 10. This allows the carrier and the rest of the tab assembly to be removed and used when the book is open to any page, as discussed above. After such use the tab assembly may be put back into catalog 410 by being adhered to any page. In addition, catalog 410 may have several carriers disposed within catalog 410.

In addition to tabs 426 having printed indicia, carrier sheet 424 may also be printed with indicia 431. If tabs 426 are made opaque, indicia 431 is positioned on the surface 433 of carrier sheet 424 so that when the user removes tab 426, indicia 431 is revealed.

Surface 433 is covered with tabs 426 until the user removes one of the tabs to reveal the hidden message(s) 439 of indicia 431. Hidden message 439 may be related to the substance of the book, in this case a catalog.

Accordingly, messages 439 will only be revealed as the user pulls tabs 426 away from carrier sheet 424. Messages 439 may be randomly placed on carrier 424 or a message 439 may be placed under each tab 426.

Thus, as a user removes individual tabs 426 from the tab assembly 424 and uses them as markers, additional messages are given to the user. Such messages could be related to the tab being pulled, such as, tab 426 relating to a "Birthday Gift" may reveal a message such as "see page 12 of our catalog". Accordingly, the printed indicia 429 of tab 426 may relate to the message 439.

Alternatively, cost incentives, discounts or prizes may be concealed as message 439 and as illustrated by the dashed lines in FIG. 10. Such messages may read as "if you order by May 15, 1996 you will receive free shipping and handling" other messages could be actual gifts, such as a gift certificates and/or prizes.

Variations of message 439 may include messages such as "better luck next time" or each message may be a prize of some sort.

Alternatively, message 439 may be spread out over the whole surface 433 of carrier 424. In this embodiment only a portion of the message will be revealed as tabs 426 are removed.

In yet another variation, message 439 may be disposed on the undersurface 432 of tab 426 or alternatively tab 426 may be used as a coupon or gift certificate.

Various embodiments of this embodiment may include a carrier 518. Carrier 518 having an actual scratch off lottery ticket being concealed on the surface 533. In this embodiment a scratch off substance 541 illustrated by the dashed lines in FIG. 11 may be placed over message 539 concealed by tab 526.

These tickets or prizes may be sponsored by the state in which the catalog is circulated or may be related to a catalog sponsored lottery. Additionally, individual contributors to the catalog may wish to place incentive messages within the catalog.

Figure 12:
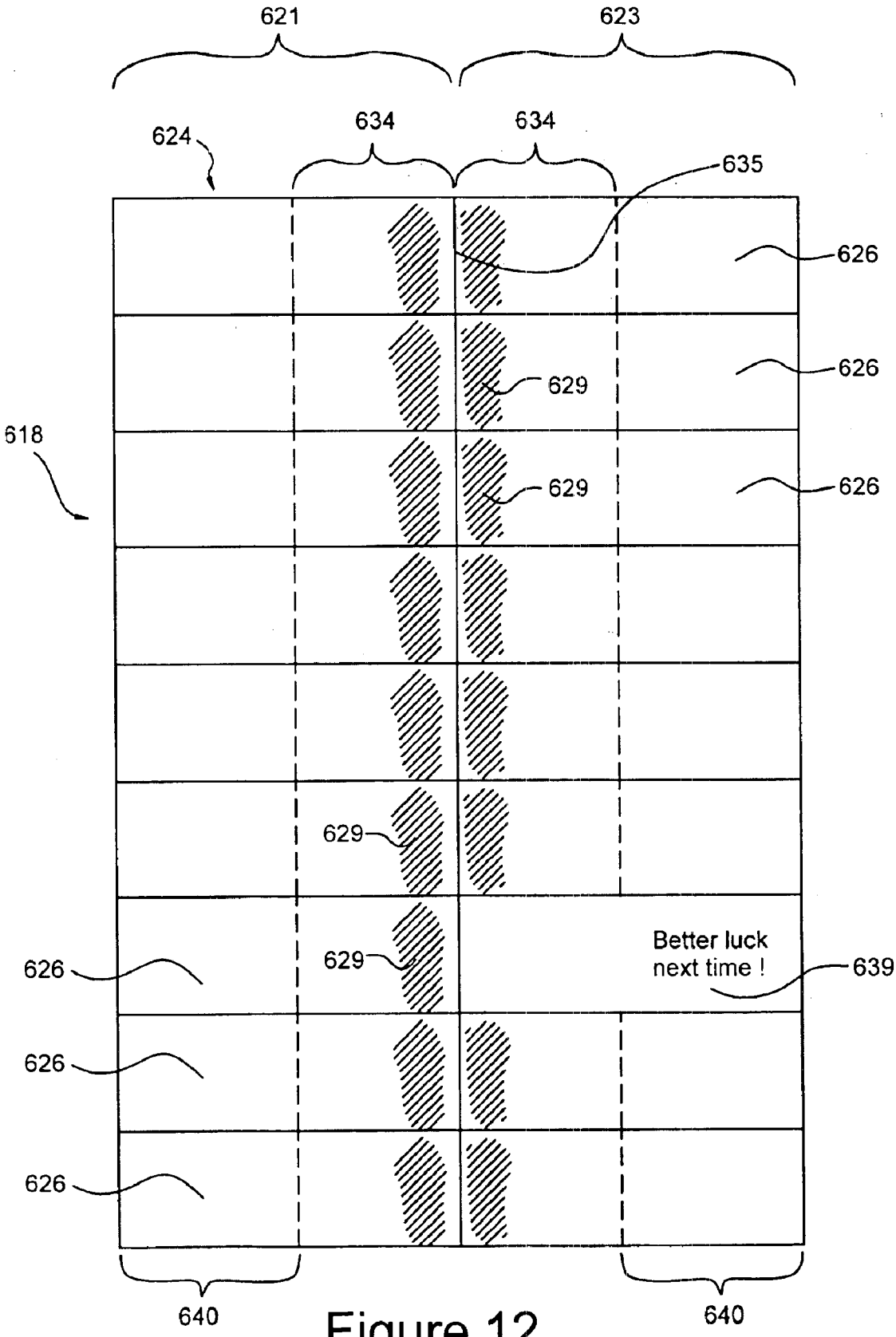
Figure 13:
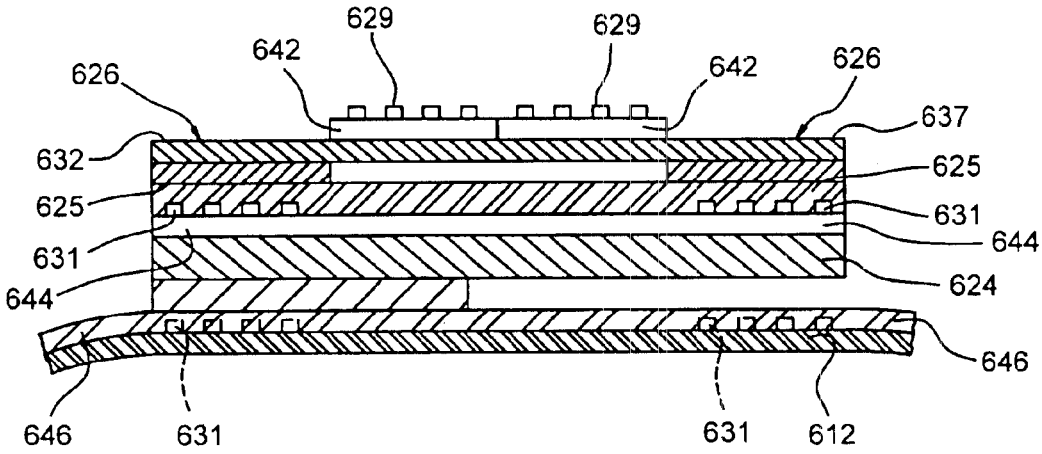

Turning now to FIGS. 12 and 13 yet another embodiment of the invention is illustrated. In particular, the tab assembly 618 comprises a carrier sheet 624 which may be made of paper or other suitable material such as plastic, composite fiber, composite fiber plastic, or the like. Adhered to carrier sheet 624 is a plurality of tabs 626.

Tabs 626 are made of an opaque flexible uncoated material such as paper. Each tab 626 has a patch of temporary non-aggressive adhesive 628 disposed on at least a portion of the undersurface 632 of tabs 626.

As can be seen in FIGS. 12 and 13, only a portion 640 of the undersurface 632 of tabs 626 is covered with adhesive 628. In this configuration a portion 634 of tab 626 is left free of adhesive 628.

Portion 634 allows tabs 626 to be easily removed and will not adhere to dust or surfaces of objects when the tab is in use, extending from the edge of a closed book. The upper surface 637 of tab 626 corresponding to portion 634 is provided with a colored background ink layer 642.

Colored background ink layer 642 is of a bright shade (such as yellow) so as to attract the eyes of a user when the catalog or book 610 is closed and portion 634 extends outwardly from the pages 612 of catalog or book 610.

Printed indicia 629 (which may be black) is positioned on top of colored background ink layer 642. Printed indicia 629 are, in accordance with the preferred embodiment, significantly darker so to clearly contrast with the color of colored background ink layer 642 for easy readability.

It is noted that indicia 629 cover on a limited portion of the upper surface 637 of tab 626 corresponding to portion 634. This provides the user with a convenient space to write.

A release agent layer 625 is disposed on the entire surface of carrier sheet 624. Release agent layer 625 is silicon based and can be sprayed upon the surface of carrier sheet 624. Release agent layer 625 allows tabs 626 to be removed from carrier sheet 624 and placed throughout book or catalog 610.

Printed indicia 631 with a colored background ink layer 644 are also positioned on the surface 633 of carrier sheet 624. Indicia are positioned to coincide with portion 640. Thus, as a user removes tab 626 printed indicia 631 and colored background ink layer 644 are revealed.

As an alternative, colored background ink layers 642 and 644 may be replaced with tabs 626 and carrier 624 each being manufactured out of a colored material such as plastic, paper, paperboard and the like. Here indicia 629 and 631 (which may be black) is positioned on top tab 626 and/or carrier 624. Printed indicia 629 and 631 are, in accordance with the preferred embodiment, significantly darker so to clearly contrast with the color of colored tab 626 and/or carrier 624 for easy readability.

Alternatively, tab 626 may be made of transparent plastic and portion 640 may be opaque. In this configuration, as a user removes tab 626, printed indicia 631 and colored background 644 on carrier sheet 624 are revealed, to tell the user that he has won a prize, to direct him to a particular area of the catalog or to inform of a discount or other promotion.

In yet another alternative embodiment, tab 626 may be made completely out opaque plastic or other suitable substance. In this configuration, portion 640 of tab 626 would provide a convenient area for a user to jot down some notes corresponding to catalog or book 610.

In yet another alternative embodiment, tab 626 may be made out paper or other suitable substance for writing and the entire upper surface 637 of tab 626 would be free from any printed indicia 629. This would provide the user with a larger are to jot down notes corresponding to catalog or book 610.

As compared to the embodiment of FIG. 12, where tabs 626 are positioned into a pair of columns 621 and 623 on carrier 624, and each column comprises a plurality of tabs 626, tabs 626 may be positioned to form more than two columns. In accordance with the invention, several carriers, such as carrier, 624 may also be positioned throughout the catalog.

Figure 11:
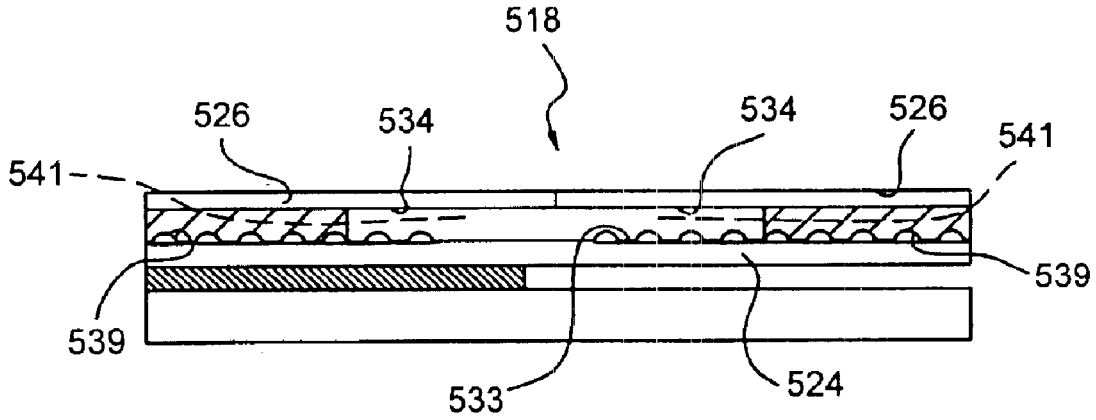
FIGS. 11–13 illustrate still other embodiments of the invention.

Likewise, features of the carrier disclosed in FIGS. 1–11 may be incorporated into the embodiment of FIGS. 11 and 12.

For example, tabs 626 may be positioned so that portion 634 of tabs 626 in column 621 aligns with portion 634 of tabs 626 in column 623. Accordingly, the center 635 of carrier 624 will be defined by portions 634 of tabs 626 which are free of adhesive. This feature allows for convenient removal of any one of tabs 626 which may be located on either side of center 635. A user may simply bend the catalog 610 or carrier 624 at center 635 until portion 634 of tab 626 may be grasped between the fingers of a user.

Likewise, in accordance with the preferred embodiment of the invention, a portion 636 of the underside 638 of carrier 624 is free of temporary adhesive, as illustrated in FIG. 13. This allows the carrier and the rest of the tab assembly to be removed and used when the book is open to any page, as discussed above. After such use the tab assembly may be put back into catalog 610 by being adhered to any page. In addition, catalog 610 may have several carriers disposed within catalog 610.

Page 612, upon which carrier 624 is located during the manufacture of the catalog incorporating carrier 624 is also equipped with a release agent layer 646 to facilitate the removal and attachment of carrier 624. Release agent layer 646 is silicon based and can be sprayed upon the surface of page 612.

As discussed above, carrier sheet 624 may also be printed with indicia 631. If tabs 626 are made opaque, indicia 631 is positioned on the surface 633 of carrier sheet 624 so that when the user removes tab 626, indicia 631 is revealed.

Surface 633 is covered with tabs 626 until the user removes one of the tabs to reveal the hidden message(s) 639 of indicia 631. Hidden message 639 may be related to the substance of the book, in this case a catalog.

Alternatively, indicia 631 may be positioned on the lower surface 632 of tabs 626. In this configuration, the hidden message 639 would not be revealed until the user removes tab 626 and looks at the lower surface 632. Variations of this embodiment may include a message 639 which states "collect five winning pieces and receive a discount". The winning pieces may comprise tabs 626 with a winning indicia 631 positioned on the lower surface 632 of tab 626.

Accordingly, carrier 624 may be equipped in some catalogs with only four winning pieces which would be an incentive to request an additional catalog 610 from a related or participating publisher to obtain the wining pieces.

Accordingly, messages 639 may be randomly placed on carrier 624 or a message 639 may be placed under each tab 626.

Thus, as a user removes individual tabs 626 from the tab assembly and uses them as markers, additional messages are given to the user. Such messages could be related to the tab being pulled, such as, tab 626 relating to a "Father's Day Gift" may reveal a message such as "Page 12, Great Ties!".

Alternative cost incentives, discounts or prizes may be concealed as message 639. Such messages may read as "Order by May 15, 1996 & get free shipping". Other messages could be actual gifts, such as a gift certificates and/or prizes.

Variations of message 639 may include messages such as "better luck next time" or each message may be a prize of some sort.

Alternatively, message 639 may require the whole surface 633 of carrier 624. In this embodiment only a portion of the message will be revealed as tabs 626 are removed. Thus, the entire carrier 624 may carry a single promotional message, and may be a coupon, gift certificate, lottery ticket or the like.

In yet another alternative embodiment and as illustrated by the dashed lines in FIG. 13, carrier 624 may be made out of a transparent material and indicia 631 may be positioned on page 612 of book or catalog 610.

In this embodiment tab 626 is opaque and printed indicia 631 is revealed as tab 626 is removed.

Alternatively, printed indicia 631 can be positioned to coincide with portion 640. Thus, as a user removes tab 626 printed indicia 631 and hidden message 639 are revealed.

Printed indicia 629 and 631 are, in accordance with the preferred embodiment, significantly darker so to clearly be seen through transparent carrier sheet 624.

Alternatively, tab 626 may be made of transparent plastic and only portion 640 may be opaque. In this configuration, as a user removes tab 626, printed indicia 631 underneath carrier sheet 624 is revealed, to tell the user that he has won a prize, to direct him to a particular area of the catalog or to inform of a discount or other promotion.

While an illustrative embodiment of the invention has been described above, it is, of course, understood that various modifications will be apparent to those of ordinary skill in the art. Such modifications are within the spirit and scope of the invention, which is limited and defined only by the appended claims.

What is claimed is:

1. A catalog, comprising:

(a) a catalog comprising a plurality of page-like members;

(b) a tab assembly carrier having an upper and lower surface and being adhered to said catalog by an adhesive, said adhesive being disposed on said lower surface, said adhesive securing said tab assembly carrier to one of said page-like members;

(c) a plurality of tabs each having an upper and a lower surface and being adhered to the upper surface of said carrier over a respective area on said tab assembly carrier by a non-aggressive adhesive, said non-aggressive adhesive being disposed on only a portion of said lower surface of said tabs, said non-aggressive adhesive allowing said tabs to be removed from said tab assembly carrier and secured to one of said page-like members, and to be removed from said one of said page-like members and secured to another one of said page-like members or said tab assembly carrier;

(d) a plurality of first items of visually perceivable indicia, each of said first items of visually perceivable indicia being disposed on a respective area of one of said page-like members, said first items of visually perceivable indicia describing a product or service; and (e) a plurality of second items of visually perceivable indicia, each of said second items of visually perceivable indicia being disposed on a respective one of said plurality of tabs, said second items of visually perceivable indicia describing a reason for a buying decision, said tabs being removable and useable as place markers by being adhered to one of said page-like members proximate to one of said first items of visually perceivable indicia describing a product or service to facilitate a possible buying action with respect to a product or service described in said one of said first items of visually perceivable indicia describing a product or service.

2. A catalog as in claim 1, wherein said page-like members each have a respective edge, the respective edges of said page-like members being bound to form a book spine using staples positioned on said spine.

3. A catalog as in claim 1, wherein said catalog has a removable address label having an upper and lower surface, said lower surface being adhered to the same page of said catalog as said tab assembly carrier by an adhesive that allows said label to be removed and used in conjunction with said ordering form.

4. An item of printed matter as in claim 1, further comprising:

(f) a plurality of third items of visually perceivable indicia, comprising third sets of visually perceivable indicia, each of said third sets of visually perceivable indicia being disposed on a respective area on said support member.

5. An item of printed matter as in claim 4, wherein said tabs cover a respective third set of visually perceivable indicia and only a portion of a third set of visually perceivable indicia is revealed when said planar members are removed.

6. An item of printed matter as in claim 5, wherein said third sets of visually perceivable indicia comprise a first visible ink-like layer disposed on a respective area on said support member, and an opaque layer disposed over a respective first visible ink-like layer, said opaque layer comprising an opaque material which may be removed by scratching.

7. An item of printed matter as in claim 6, wherein said third sets of visually perceivable indicia further comprise a second visible ink-like layer disposed over a respective opaque layer.

8. An item of printed matter as in claim 1, wherein said second items of visually perceivable indicia identify an event such as a holiday, birthday or graduation.

9. An item of printed matter as in claim 1, wherein said second items of visually perceivable indicia identify a person by category, such as mother or baby.

10. An item of printed matter as in claim 1, wherein said tabs comprise a single layer of tabs positioned to substantially cover said support member.

11. An item of printed matter as in claim 1, further comprising an ordering form secured to one of said page-like members.

12. A catalog as in claim 1, wherein said page-like members comprise a pair of cover leafs and a plurality of pages positioned between said pair of cover leafs, each of said plurality of pages and said pair of cover leafs having a respective edge, the respective edges of said pages and said cover leafs being bound to form a book spine, said second items of visually perceivable indicia identify an event such as a holiday, birthday or graduation, said second items of visually perceivable indicia identify a person by category, such as mother or baby, and said non-aggressive adhesive is disposed only on a portion of said lower surface of said tabs, and further comprising an ordering form secured to one of said page-like members.

13. An item of printed matter as in claim 1, wherein said page-like members comprise a pair of cover leafs and a plurality of pages positioned between said pair of cover leafs, each of said plurality of pages and said pair of cover leafs having a respective edge, the respective edges of said pages and said cover leafs being bound to form a book spine, said second items of visually perceivable indicia identify an event such as a holiday, birthday or graduation, said second items of visually perceivable indicia identify a person by category, such as mother or baby, and further comprising an ordering form secured to one of said page-like members, and a plurality of third items of visually perceivable indicia, said third items of visually perceivable indicia comprising third sets of visually perceivable indicia, each of said third sets of visually perceivable indicia being disposed on a respective area on said support member, each of said planar members covering its respective third item of visually perceivable indicia and only a portion of a respective third set of visually perceivable indicia being revealed when said planar members are removed, said third items of visually perceivable indicia comprising a first visible ink-like layer disposed on a respective area on said support member, an opaque layer disposed over a respective first visible ink-like layer, said opaque layer comprising an opaque material which maybe removed by scratching, and a second visible ink-like layer disposed over a respective opaque layer.

14. An item of printed matter as in claim 1, wherein said tabs are disposed in a single layer.

15. An item of printed matter as in claim 14, wherein each tab comprises paper having a blank portion whereby an individual may make notations.

16. A method of selling and purchasing items between a selling catalog sales operator and persons making purchasing decisions, comprising the steps of imprinting on a catalog elements of descriptive information respecting a plurality of products which it is desired to sell, each element of descriptive information being printed on one of a plurality of areas contained within said catalog, said descriptive information being printed in the form of a plurality of first items of visually perceivable indicia, using each of said first items of visually perceivable indicia to convey information to persons making purchasing decisions in a respective targeted class of individuals, securing to said catalog a tab assembly carrier having an upper and lower surface, said tab assembly carrier being secured to said catalog, adhering a plurality of tabs to the upper surface of said tab assembly carrier, printing on each of said tabs a plurality of second items of visually perceivable indicia, each of said second items of visually perceivable indicia being printed on a respective one of said tabs, said visually perceivable indicia indicating certain needs and disposed on an upper surface of said tabs, applying a second adhesive to a lower surface of said tabs, sending said catalog to one of said persons making buying decisions one of said persons making purchasing decisions reviewing said catalog, said one of said persons making purchasing decisions removing said tabs from said tab assembly carrier and relocating said tabs at a position associated with one of said plurality of first items of visually perceivable indicia, said tab functioning at said position as a book place marker, and said persons making a buying decision implementing said decision by sending an order to said catalog sales operator.

17. A method as in claim 16, wherein said first adhesive is a non-aggressive adhesive, and further comprising the steps of removing said tab assembly carrier from said catalog, using said carrier in connection with making purchasing decisions by removing tabs from said carrier, and adhering said carrier to said catalog.

18. A printed book-like catalog having a plurality of pages bound to form a multiple page catalog for facilitating a purchasing decision and resultant purchasing act, comprising:

a) a print bearing member comprising said plurality of pages of said catalog, b) a plurality of areas being defined on said pages of said catalog, said areas having first items of visually perceivable indicia identifying various products or services for sale in said catalog, each of said first items of visually perceivable indicia conveying first information respecting said products to a respective targeted class of consumers, c) a plurality of tabs adhered to a surface of one of said pages, said tabs defining an upper surface, a lower surface and an adhesive, said adhesive being disposed on a portion of said lower surface of said tabs, said adhesive being a temporary adhesive and allowing said tabs to be removed from said one of said pages and relocated at a first position associated with one of said areas, said adhesive also allowing at least a second relocation to a second area, each of said tabs having a plurality of second items of visually perceivable indicia, each of said second items of visually perceivable indicia being disposed on a respective one of said tabs and conveying second information to said respective targeted class of individuals, said second information and said first information being related to said purchasing decision and resultant purchasing act.

19. An item of printed matter as in claim 18, wherein one of said pages is coated with a release agent, whereby said tabs may be easily removed from one of said pages.

20. An item of printed matter as in claim 18, wherein said second information identifies individuals in general categories such as mother, son or wife, or identifies occasions, such as a birthday, Mother's Day or an anniversary or a task such as back to school.

21. A catalog as in claim 1, wherein said non-aggressive adhesive allows said tabs to be repeatedly positioned and repositioned as a place marker on said pages.

* * * * *